US006461565B2

(12) United States Patent
Tokuhara et al.

(10) Patent No.: US 6,461,565 B2
(45) Date of Patent: Oct. 8, 2002

(54) METHOD OF PRESSING RARE EARTH ALLOY MAGNETIC POWDER

(75) Inventors: Koki Tokuhara, Hyogo (JP); Shuhei Okumura, Osaka (JP); Akiyasu Oota, Sanda (JP)

(73) Assignee: Sumitomo Special Metals Co., Ltd. (JP)

( * ) Notice: Subject to any disclaimer, the term of this patent is extended or adjusted under 35 U.S.C. 154(b) by 0 days.

(21) Appl. No.: 09/801,096

(22) Filed: Mar. 8, 2001

(65) Prior Publication Data

US 2002/0006347 A1 Jan. 17, 2002

(30) Foreign Application Priority Data

Mar. 8, 2000 (JP) ..... 2000-062921
May 30, 2000 (JP) ..... 2000-160674

(51) Int. Cl.[7] ..... B22F 3/12

(52) U.S. Cl. ..... 419/38; 419/28; 419/33; 419/66

(58) Field of Search ..... 419/38, 66, 23

(56) References Cited

U.S. PATENT DOCUMENTS 4,881,986 A * 11/1989 Sato et al. ..... 148/103
5,011,552 A * 4/1991 Otsuka et al. ..... 148/302

FOREIGN PATENT DOCUMENTS

| | | |
|---|---|---|
| JP | 63-033505 A | 2/1988 |
| JP | 63-211707 | 9/1988 |
| JP | 05-295490 | 11/1993 |
| JP | 06-140220 A | 5/1994 |
| JP | 10-022154 A | 1/1998 |

OTHER PUBLICATIONS

Inventors: Seiichi Kohara et al., U.S. patent application Ser. No. 09/472,247 and Amendment, filed: Dec. 27, 1999, Specification and Drawings, Title: Process and Apparatus for Supplying Rare Earth Metal–Based Alloy Powder.

Inventors: Seiichi Kohara et al., U.S. patent application Ser. No. 09/421,237, filed: Oct. 20, 1999, Specification and Drwaings, Title: "Powder Pressing Apparatus and Powder Pressing Method".

* cited by examiner

*Primary Examiner*—Daniel J. Jenkins
(74) *Attorney, Agent, or Firm*—Nixon Peabody LLP; Jeffrey L. Costellia

(57) ABSTRACT

A green compact of a rare earth alloy magnetic powder is made by pressing the powder. The powder is pressed within an air environment that has a temperature controlled at 30° C. or less and a relative humidity controlled at 65% or less.

12 Claims, 2 Drawing Sheets

METHOD OF PRESSING RARE EARTH ALLOY MAGNETIC POWDER

BACKGROUND OF THE INVENTION

1. Field of the Invention

The present invention relates to a method of making a green compact of a rare earth alloy magnetic powder and a method of producing a rare earth permanent magnet.

2. Description of the Related Art

A rare earth alloy sintered magnet is produced by pulverizing a rare earth alloy into a magnetic alloy powder, pressing and compacting the powder into a green compact in a desired shape and then subjecting green compact to sintering and aging processes. Currently, rare earth alloy sintered magnets have found a broad variety of applications and are typically made of either a samarium-cobalt compound or a neodymium-iron-boron compound. A neodymium-iron-boron magnet (which will be herein called an "R—T—B magnet"), in particular, has a higher maximum energy product than a magnet of any other type, and yet is available at a reasonable price. Accordingly, R—T—B magnets have been used for various kinds of electronic appliances with increasing frequency. In an R—T—B magnet, R is a rare earth element including Y, T is either iron or a compound of iron and a transition metal (e.g., Co) in which iron is partially replaced with the metal, and B is boron. Part of boron can be replaced with carbon.

To prepare such a rare earth alloy, an ingot casting process has been used. In an ingot casting process, a molten material alloy is poured (or teemed) into ingot casting molds and then cooled down relatively slowly. The alloy ingot, once formed by this ingot casting process, is pulverized into an alloy powder by a known technique. Next, the resultant alloy powder is pressed and compacted by various types of powder presses, forming a green compact. Finally, the green compact is loaded into a furnace chamber for sintering.

Recently, however, a rapid quenching process, like strip casting or centrifugal casting, has been preferred. In a rapid quenching process, a solidified alloy strip or flake, thinner than an alloy ingot, can be made from a molten alloy by contacting the melt with single or twin roller, rotating disk or rotating cylindrical mold, for example, so that the alloy is quenched relatively rapidly. An alloy strip prepared by a process like this generally has a thickness of 0.03 mm to 10 mm. According to the rapid quenching process, the molten alloy starts to be solidified at the surface being in contact with the chill roller (which will be herein called a "roller-alloy contact surface"). Then, columnar crystals grow from the roller-alloy contact surface in the thickness direction, or outward. Accordingly, when prepared by a strip casting method, for example, a rapidly solidified alloy has a structure including a combination of $R_2T_{14}B$ crystal phases and R-rich phases. Normally, the sizes of each of the $R_2T_{14}B$ crystal phases are from 0.1 $\mu$m through 100 $\mu$m in the minor axis direction and from 5 $\mu$m through 500 $\mu$m in the major axis direction. The R-rich phases exist dispersively around the grain boundaries of the $R_2T_{14}B$ crystal phases. Also, each of the R-rich phases is a non-magnetic phase in which the concentration of the rare earth element R is relatively high, and has a thickness of 10 $\mu$m or less, corresponding to the width of the associated grain boundary.

In a rapid quenching process, an alloy is quenched and solidified in a shorter time (at a cooling rate between $10^{2}$° C./sec. and $10^{4}$° C./sec.) compared to the conventional ingot casting process. Thus, the rapidly solidified alloy can have a finer micro-structure and a smaller crystal grain size. In addition, the grain boundary (or intergranular phases) of the alloy of this type has a broader area and includes a thin layer of R-rich phases. As a result, the rapidly solidified alloy advantageously exhibits a wider dispersion of R-rich phases.

However, the present inventors found that if a magnetic powder of a rapidly solidified alloy (e.g., a strip cast alloy, typically) is compacted by a known pressing technique, the as-pressed, green compact has a potential to generate sufficient heat for combustion, depending on the particular state of the environment. This is probably because easily oxidizable R-rich phases are often exposed on the surface of powder particles of the rapidly solidified alloy, thus making the powder of the rapidly solidified alloy subject to oxidation and the resultant heat therefrom. Also, even if the heat from the oxidation of the powder is insufficient to cause combustion, the oxidization may deteriorate the magnetic properties of resultant magnets.

The heat generation resulting from the oxidization of rare earth elements is also observable when the powder of a rare earth alloy, prepared by a known ingot casting process, is pressed and compacted. However, the heat generation is markedly increased when the pressed and compacted powder is made from a rapidly solidified alloy (e.g., a strip cast alloy, in particular). Accordingly, even though a rapidly solidified alloy powder has a finer structure and potentially contributes to better magnetic properties, the rapid quenching process is still unqualified for mass production so long as there is any risk of heat generation or combustion left during the pressing.

It is possible to suppress oxidation of the rare earth alloy powder by carrying out the pressing and compacting process within an inert gas environment. However, pressing within an inert gas environment is far from a practical approach to the oxidation problem. This is because even though a pressing process can be performed fully automatically using a compacting machine, the process itself still requires frequent maintenance. That is to say, workers often have to check the presses. For example, in the event that a press placed within an inert gas (e.g., $N_2$) environment fails, a worker must tend to the machine. However, the worker must either bring his own supply of oxygen, or he must replace the inert gas environment with a breathable environment. Moreover, placing the press entirely within such an inert gas environment requires an large amount of inert gas. Accordingly, this approach is neither cost-effective nor practical.

SUMMARY OF THE INVENTION

It is therefore an object of the present invention to provide a method of making a green compact of a rare earth alloy magnetic powder in such a manner as to avoid the combustion accidents and to attain superior magnetic properties even when the powder is easily oxidizable.

It is another object of the invention to provide a method of producing a rare earth permanent magnet by utilizing the inventive powder compacting method.

According to an embodiment of the powder compacting method of the present invention, a green compact of a rare earth alloy magnetic powder is made by pressing the powder within an air environment that has a temperature controlled at 30° C. or less and a relative humidity controlled at 65% or less.

According to another embodiment of the compacting method of the present invention, a green compact of a rare earth alloy magnetic powder is pressed in an air environment that also has a temperature controlled at 30° C. or less. The temperature minus a dew point is controlled at 6° C. or more. As used herein, the "dew point" is the temperature at which a given parcel of air is saturated with water vapor.

In one embodiment of the compacting method of the present invention, the powder may be prepared by pulverizing a rapidly solidified alloy that has been obtained by quenching a molten alloy at a rate from $10^{2}$° C./sec. through $10^{4}$° C./sec.

In this particular embodiment, the rapidly solidified alloy is a rare earth alloy with a thickness between 0.03 mm and 10 mm, and preferably includes $R_2T_{14}B$ crystal grains (where R is a rare earth element, T is either iron or a compound of iron and a transition metal element in which iron is partially replaced with the metal, and B is boron) and R-rich phases. The sizes of the $R_2T_{14}B$ crystal grains are preferably from 0.1 $\mu$m to 100 $\mu$m in a minor axis direction, and from 5 $\mu$m to 500 $\mu$m a major axis direction. The R-rich phases are dispersed around a boundary of the $R_2T_{14}B$ crystal grains.

In another embodiment of the present invention, a lubricant is preferably added to the powder being pressed.

In still another embodiment of the present invention, oxygen contained in the powder is preferably limited to 6,000 ppm or less by weight.

In yet another embodiment of the present invention, the rapidly solidified alloy is finely pulverized using a jet mill with the concentration of an oxidizing gas controlled in a pulverization chamber, thereby forming an oxide layer on the surface of particles of the finely pulverized powder.

In yet another embodiment of the present invention, the alloy powder is pressed in an air environment that also has a temperature controlled at 5° C. or more and has a relative humidity controlled at 40% or more. The alloy powder is pressed in an air environment that also has a temperature controlled at 30° C. or less More preferably, the alloy powder is pressed in an air environment that has a temperature controlled at a point between 15° C. and 25° C., and a relative humidity controlled at a point between 40% and 55%.

In a preferred embodiment of the present invention, a die pressing machine is used. The machine includes: a die with a die hole for forming at least part of a cavity therein; and first and second punches for compacting the powder inside the hole. The method preferably includes the step of filling the cavity with the powder with at least an upper end of the second punch inserted into the die hole. The method further includes the steps of: inserting at least a lower end of the first punch into the die hole and compacting the powder between the first and second punches, thereby making the green compact of the powder; and ejecting the compact out of the die hole.

An embodiment of the present invention for producing a rare earth permanent magnet includes the steps of: preparing the green compact of the rare earth alloy magnetic powder according to any embodiment of the inventive powder compacting method; and sintering the compact.

In one embodiment of the present invention, after the powder has been pressed to make the green compact in a first chamber having the air environment, the compact is transported to a second chamber having an environment at a controlled temperature, which is different from the temperature of the air environment by 5° C. or less, and then sintered in the second chamber. In this particular embodiment, the first chamber is preferably big enough for a human being to work therein.

DESCRIPTION OF THE PREFERRED EMBODIMENTS

Figure 1:
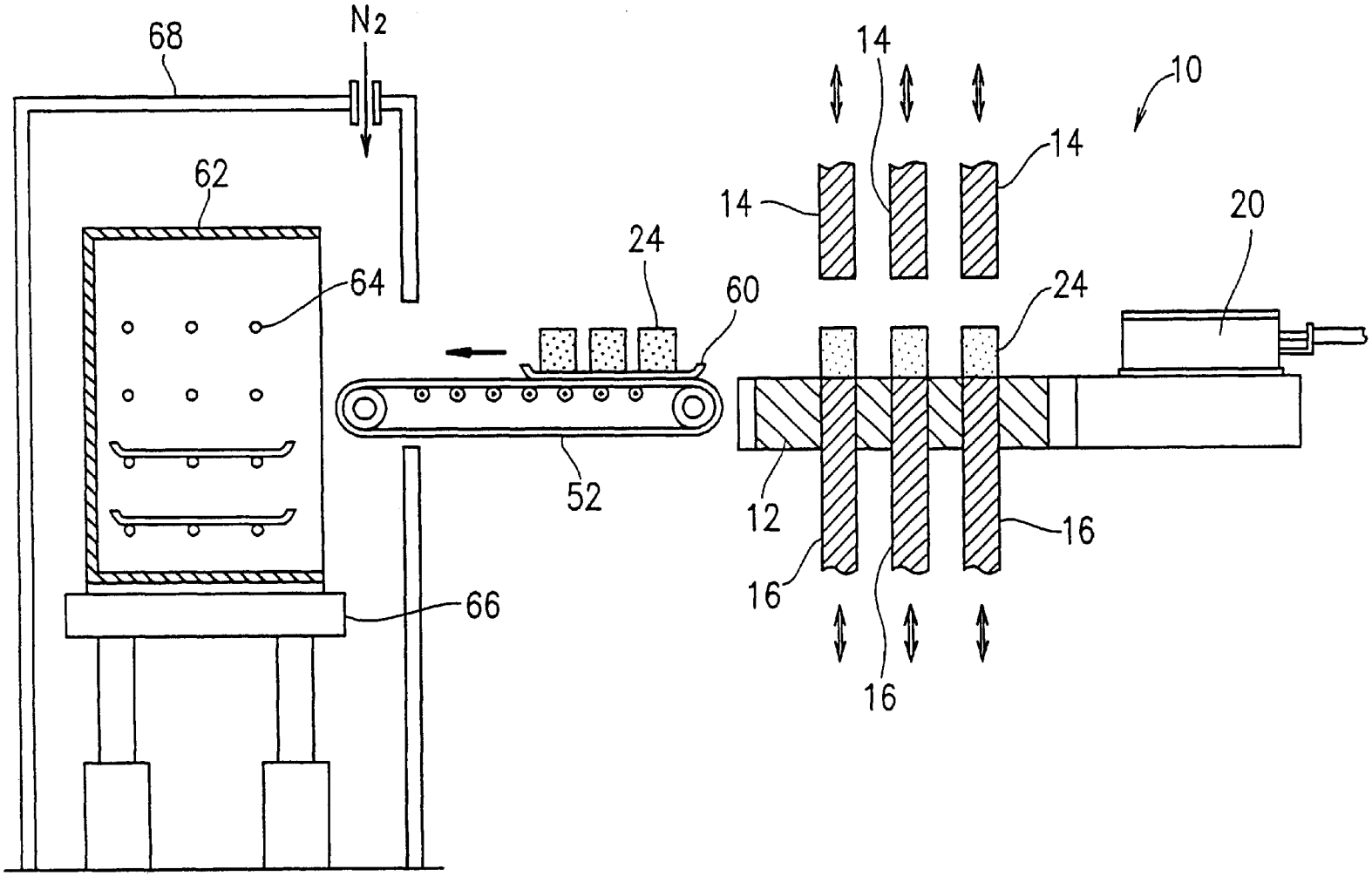
FIG. 1 schematically illustrates a pressing machine and its surrounding members for use in the present invention.

A rare earth element, such as Nd, contained in a rare earth permanent magnet is very easily oxidizable as described above. But the oxidizability of a rare earth alloy powder is greatly affected by the temperature and humidity of an ambient gas before, during, and after the powder is pressed in a compacting process, and so is controllable by adjusting these conditions. That is to say, preferred methods of the present invention prevent the as-pressed, green compact of a rare earth alloy powder from generating too much heat, thereby combusting, by appropriately controlling the temperature and humidity of the ambient gas.

Where a rare earth alloy powder is compacted into a desired shape by pressing it, the temperature of the resultant green compact sometimes reaches as high as 45° C. or more just after the compact has been ejected. This is because a lot of friction is produced between the powder particles and between the compact surface and the faces of the die cavity hole of a pressing machine. For that reason, the as-pressed compact has very high chemical reactivity. That is to say, a rare earth element exposed on the surface of the rare earth alloy magnetic powder particles that make up the compact readily reacts with oxygen or water vapor in the air. The results of experiments indicated that when the temperature and humidity of the air environment were both high during the pressing process, water vapor, contained in the air environment, actively reacted with the rare earth element exposed on the surface of the compact to form hydroxides. A rare earth alloy for use in producing an R—T—B rare earth permanent magnet is oxidized much faster by way of that hydroxide forming process than by direct bonding of the rare earth element to oxygen. This is why an increased humidity of the air environment results in a faster temperature rise of the as-pressed rare earth alloy powder. As a result, the green compact is more likely to generate too much heat, possibly combusting, in a worst-case scenario.

Thus, according to the present invention, this heat-generating reaction is suppressed by controlling both the temperature and humidity of the environment to appropriate ranges during the pressing process, facilitating safe and consistent production of rare earth alloy magnet with superior magnetic properties.

Hereinafter, preferred embodiments of the present invention will be described with reference to the accompanying drawings.

Alloy Powder Preparation

First, cast flakes of an R—Fe—B rare earth magnet alloy are prepared by a known strip-casting technique. Specifically, an alloy, which contains 30 wt % of Nd, 1.0 wt % of B, 1.2 wt % of Dy, 0.2 wt % of Al, 0.9 wt % of Co, 0.2 wt % of Cu and the balance of which is Fe and inevitable impurities, is melted by a high-frequency melting process, thereby obtaining a melt of the alloy. The molten alloy is kept at 1350° C. and then rapidly quenched by a single roller process to obtain a flake-like cast ingot of the alloy with a thickness of 0.3 mm. The rapid quenching process is performed under the conditions that the peripheral surface velocity of the roller is about 1 m/sec., the cooling rate is about 500° C./sec. and sub-cooling temperature is 200° C.

The thickness of the rapidly solidified alloy prepared this way is in the range from 0.03 mm to 10 mm. The alloy contains $R_2T_{14}B$ crystal grains and R-rich phases dispersed around the grain boundaries of the $R_2T_{14}B$ crystal grains. The sizes of the $R_2T_{14}B$ crystal grains are from 0.1 $\mu$m to 100 $\mu$m and from 5 $\mu$m to 500 $\mu$m in the minor and major axis directions, respectively. The thickness of the R-rich phases is 10 $\mu$m or less. A method of making a material alloy by the strip-casting technique is disclosed in U.S. Pat. No. 5,383,978, for example.

Next, the flake-like cast alloy ingot is filled into material packs, which are subsequently loaded into a rack. Thereafter, the rack loaded with the material packs is transported to the front of a hydrogen furnace using a material transporter and then introduced into the hydrogen furnace. The material alloy is heated and subjected to the hydrogen pulverization process inside the furnace. The material alloy, roughly pulverized this way, is preferably unloaded after the temperature of the alloy has decreased approximately to room temperature. However, even if the material alloy is unloaded while the temperature of the alloy is still high (e.g., in the range from about 40° C. to about 80° C.), the alloy is not oxidized so seriously unless the alloy is exposed to the air. As a result of this hydrogen pulverization process, the rare earth alloy is roughly pulverized into a size of about 0.1 mm to about 1.0 mm. As described above, before subjected to this hydrogen pulverization process, the material alloy has preferably been pulverized more roughly into flakes with a mean particle size between 1 mm and 10 mm.

After the material alloy has been pulverized roughly through this hydrogen pulverization process, the brittled alloy is preferably crushed more finely and cooled down using a cooling machine such as a rotary cooler. If the unloaded material still has a relatively high temperature, then the material may be cooled for an increased length of time.

Thereafter, the material powder, which has been cooled down approximately to room temperature by the rotary cooler, is further pulverized even more finely to make a fine powder. In the illustrated embodiment, the material powder is finely pulverized using a jet mill within a nitrogen gas environment, thereby obtaining an alloy powder with a mass median diameter (MMD) of about 3.5 $\mu$m. The concentration of oxygen in this nitrogen gas environment should preferably be as low as about 10,000 ppm. A jet mill for use in such a process is disclosed in Japanese Patent Publication for Opposition No. 6-6728, for example. More specifically, the weight of oxygen contained in the finely pulverized alloy powder should preferably be 6,000 ppm or less, tpically in a range 3500 to 6000 ppm, by controlling the concentration of an oxidizing gas (i.e., oxygen or water vapor) contained in the ambient gas used for the fine pulverization process. This is because if the weight of oxygen contained in the rare earth alloy powder exceeds 6,000 ppm, then the total percentage of non-magnetic oxides in the resultant sintered magnet will generally be too high to realize superior magnetic properties.

Subsequently, a lubricant (e.g., at 0.3 wt %) is added to and mixed with this alloy powder in a rocking mixer, thereby coating the surface of the alloy powder particles with the lubricant. As the lubricant, an aliphatic ester diluted with a petroleum solvent may be used. In the illustrated example, methyl caproate is used as the aliphatic ester and isoparaffin is used as the petroleum solvent. Methyl caproate and isoparaffin may be mixed at a weight ratio of 1:9, for example. A liquid lubricant like this will not merely prevent the oxidation of the powder particles by coating the surface thereof, but also eliminate disordered orientations from the green compact by uniformizing the density of the compact during the pressing process.

It should be noted that the lubricant is not limited to the exemplified type. For example, methyl caproate as the aliphatic ester may be replaced with methyl caprylate, methyl laurylate or methyl laurate. Examples of usable solvents include petroleum solvents such as isoparaffin and naphthene solvents. The lubricant may be added at any arbitrary time, including before, during or after the fine pulverization. A solid (dry) lubricant like zinc stearate may also be used instead of, or in addition to, the liquid lubricant.

Description of Pressing Machine

FIG. 1 illustrates the arrangement of a pressing machine 10 and its surrounding members for use in the illustrated embodiment. In this embodiment, the pressing machine 10 is placed in a pressing chamber filled with the air that is conditioned by a known air-conditioning system (e.g., a standard room air conditioner). The air inside the pressing chamber has a temperature controlled to 30° C. or less and a relative humidity controlled to 65% or less.

As shown in FIG. 1, the pressing machine 10 includes: a die 12 with a plurality of die holes for forming cavities therein; and upper and lower punches 14 and 16 for compacting the powder inside the holes. Cavities are formed over the lower punches 16 with the upper part of the lower punches 16 inserted into the holes of the die 12. The powder can be fed into the cavities by moving a feeder box 20, filled with the powder, onto the cavities and dropping the powder from the bottom of the feeder box 20 with openings into the cavities. The cavities cannot be filled with the powder uniformly if the powder is allowed to drop by gravitational force alone. Accordingly, the alloy powder is preferably forced into the cavities by horizontally driving a shaker (not shown) built in the feeder box 20. Such a shaker is disclosed in copending U.S. patent application Ser. No. 09/472,247, which application is incorporated herein by reference. When the feeder box 20 goes back to its home position (i.e., rightward in the example illustrated in FIG. 1), the bottom edges of the feeder box 20 rub and level out the superfluous part of the filled powder. As a result, a predetermined weight of powder to be compacted can be filled into the cavities.

Figure 2:
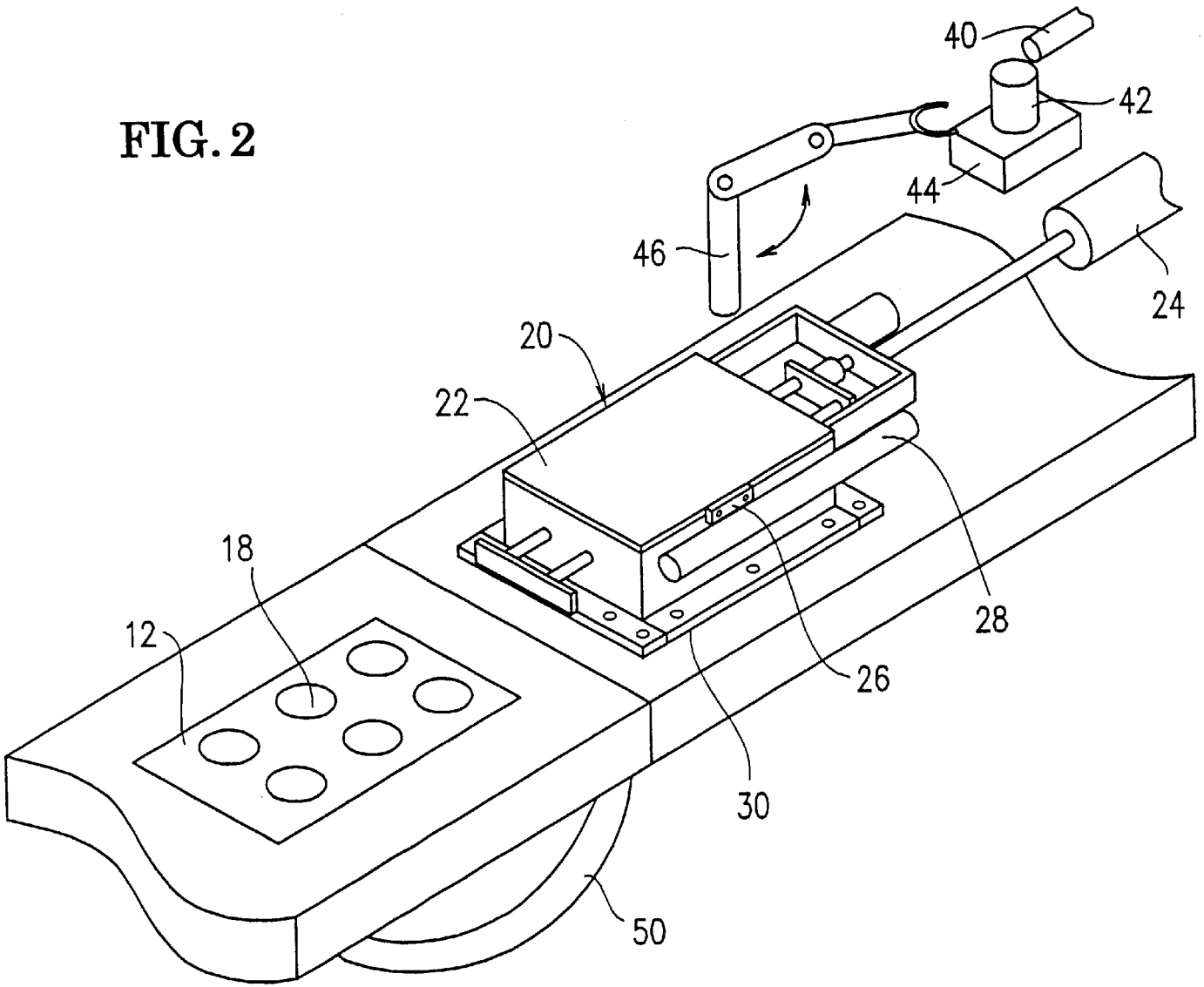
FIG. 2 is a perspective view illustrating details of the pressing machine.

Feeding of the alloy powder is described in further detail with reference to FIG. 2. The feeder box 20 is driven by an air cylinder 24 so as to horizontally move from a position where the box 20 is fed with the powder to a position over the cavities 18, and vice versa. A cap 22 is attached to the top of the box 20 so as to close the box 20 airtight. More specifically, the cap 22 is connected to the body of the box 20 via a metal member 26 and can be opened or closed by another air cylinder 28. Nitrogen gas is supplied into the box 20 so that the alloy powder contained is not exposed to the air and thereby oxidized. On the bottom of the box 20, thin plates 30 (with a thickness of about 5 mm) made of a fluorine resin are attached. The thin plates 30 allow the box 20 to slide smoothly over the base plate of the pressing machine 10 and reduce the amount of the alloy powder stuck between the box 20 and the machine 10.

The alloy powder is supplied by a vibrating trough 40 into a feeder cup 42 and has its weight measured by a scale 44. When the weight of the alloy powder contained in the cup 42 reaches a predetermined level, a robot arm 46 grips the feeder cup 42 and feeds the alloy powder contained in the cup 42 into the feeder box 20.

As described above, there are multiple openings at the bottom of the feeder box 20. Accordingly, when the box 20 is located over the cavities 18, the alloy powder is fed from the box 20 into the cavities 18.

Referring back to FIG. 1, once the powder has been filled into the cavities 18, the upper punches 14 start to fall. Also, a magnetic field is generated by a coil 50 (see FIG. 2), in the vicinity of the powder inside the cavities 18 to magnetically align the powder. Then, the alloy powder inside the cavities 18 is pressed and compacted by the upper and lower punches 14 and 16, thereby forming powder compacts 24 in the cavities 18. Thereafter, the upper punches 14 rise back to their home positions, while the lower punches 16 push the compacts 24 upward. In this manner, the compacts 24 are ejected out of the die 12. FIG. 1 illustrates a state where the lower punches 16 have pushed upward and fully ejected the compacts 24 from the die 12. During this ejecting step, large frictions are caused between the surface of the compacts 24 and the inner wall of the cavities 18. Such frictions generate heat and increase the temperature of the compacts 24, which leads to combustion of the compacts 24. To reduce the frictions, the inner walls of the cavities 18 can be preferably coated with lubricant prior to feeding the alloy powder into the cavities 18. The method and device for supplying lubricant onto the inner wall of the cavities 18 is disclosed in copending U.S. patent application Ser. No. 09/421,237, which application is incorporated herein by reference.

After this pressing/compacting process is over, the compacts 24, ejected by the lower punches 16, are placed by a transporting robot (not shown) onto a sintering plate (with a thickness of 0.5 mm to 3 mm) 60. The plate 60 may be made of molybdenum, for example. The compacts 24 on the plate 60 are transported by a conveyor 52 so as to be loaded into a sintering case 62 that is disposed in a chamber with a nitrogen environment. The sintering case 62 is preferably constructed of thin metal plates (with a thickness of 1 mm to 3 mm) made of molybdenum, for example. The body frame of the sintering case 62 is a box shaped container with an opening between two opposite side faces. The opening is closed with a door (not shown) that slides vertically. Inside the body frame, multiple molybdenum supporting rods 64 extend horizontally (viewed end-on in FIG. 1). Each of these rods 64 is supported by the two opposite side plates. Also, the rods 64 are so arranged as to support the plates 60, on which the compacts 24 are placed, substantially horizontally inside the body frame. Accordingly, the plates 60 holding the compacts 24 can be inserted into the sintering case 62 through the opening of the body frame. The plate 60 being inserted slides horizontally on the rods 64. In this case, only slight friction is caused between the plate 60 and rods 64 and these members 60 and 64 are hardly worn, because they 60 and 64 are both made of molybdenum with high self-lubricating properties.

The vertical position of the sintering case 62 is controllable using a lift 66. That is to say, the case 62 may be lowered or raised so as to receive a plate 60 on a desired level. When the sintering case 62 is in a desired height, the plate 60 is transported by the conveyor 52 and placed onto the rods 64.

Once a predetermined number of compacts 24 have been loaded into the sintering case 62, the door of the case 62 is closed to maintain a substantially airtight condition inside the case 62. In this manner, the inside of the case 62 can maintain the nitrogen environment for an extended period of time. After that, the case 62 is transported from the pressing chamber to the sintering chamber, not shown. The temperature inside the sintering chamber is higher than any other chamber, because the sintering furnace generates a large amount of heat. Accordingly, if the air environment inside the pressing chamber has too low a temperature, then condensation will be caused on the surface of the compacts 24 when the case 62 arrives at the sintering chamber. As a result, hydroxides might be formed on the surface of the compacts 24. These hydroxides promotes the oxidation of the rare earth element so much that the temperature of the compacts 24 rises steeply. As a result, the risk of combustion due to heat generation from the oxidation increases tremendously. Accordingly, the difference in temperature between the environment in the pressing chamber is preferably no greater than 5° C. and the environment in the destination chamber (e.g., sintering chamber), to which the compacts 24 are to be transported.

During this series of process steps, static electricity is accumulated in the rare earth alloy powder particles. Friction, causing this static electricity, is produced, for example, when the alloy powder is scaled or fed.

In introducing the powder into the cup 42, friction is caused between the alloy powder particles or between the particles and the cup 42. Also, in making the alloy powder flow through the trough 40, friction is caused between a screw feeder (not shown) and the alloy powder when the feeder box 20 slides over the die 12. At the bottom of the feeder box 20, friction is caused due to the direct contact of the upper surface of the die 12 with the alloy powder. Also, since the alloy powder is stirred as the box 20 moves, friction is produced between the particles. When the shaker moves inside the feeder box 20 friction is produced between the shaker and the alloy powder. When the powder is compacted by the upper and lower punches 14 and 16 friction is caused between the alloy powder particles being compacted. Finally, when the powder compacts are ejected from the die 12 friction is produced between the surface of the compacts 24 and the surface of the die 12.

The static electricity generated by these types of friction and accumulated in the compacts or respective parts of the pressing machine increases the risk of combustion. It is believed that according to the known pressing method, such combustion particularly likely occurs just after the green compacts have been ejected from the die. In contrast, according to the inventive pressing method, the press environment can have its temperature and humidity controlled appropriately and the risk of heat generation or combustion of the as-pressed compacts can be reduced considerably.

The compacts 24, formed by performing the foregoing process steps, are sintered by a known technique and then subjected to surface polishing and other processes. As a result, final products, or rare earth permanent magnets, are completed.

EXAMPLES AND COMPARATIVE EXAMPLES

A rare earth alloy powder, which had been prepared by the above process, was pressed with the temperature and humidity of the environment inside a pressing chamber controlled to obtain ten green compacts with sizes of 30 mm×20 mm×50 mm. The average magnetic properties of these compacts and the average number of times the compacts combusted were measured. The density of the compacts was 4.4 g/cm$^3$ and a magnetic field of 0.8 MA/m was applied vertically to the direction in which the powder was compacted. Thereafter, the as-pressed compacts were sintered at 1050° C. for two hours within an argon environment.

As indicated above, the term "dew point" refers to the temperature at which a given parcel of air is saturated with water vapor. The following Table 1 shows the results of the experiments:

TABLE 1

| Experiment No. | Temperature during pressing (° C.) | Relative Humidity During Pressing (%) | No. of Incidents of Combustion | Coercivity Hcj (kA/m) | Remanence Br (T) | Maximum Energy Product $(BH)_{max}$ (kJ/m$^3$) | Dew Point (° C.) | Temperature Minus Dew Point (° C.) |
|---|---|---|---|---|---|---|---|---|
| Example 1 | 30 | 45 | 0 | 1122 | 1.33 | 342 | 16 | 14 |
| Example 2 | 23 | 52 | 0 | 1257 | 1.38 | 355 | 12 | 11 |
| Example 3 | 28 | 49 | 0 | 1209 | 1.34 | 346 | 16 | 12 |
| Example 4 | 20 | 56 | 0 | 1254 | 1.36 | 358 | 13 | 10 |
| Example 5 | 18 | 60 | 0 | 1260 | 1.37 | 352 | 10 | 8 |
| Example 10 | 10 | 55 | 0 | 1260 | 1.38 | 352 | 1 | 9 |
| Example 11 | 18 | 65 | 0 | 1255 | 1.36 | 350 | 11 | 7 |
| Comp. Ex. 6 | 32 | 65 | 3 | 954 | 1.25 | 302 | 24 | 8 |
| Comp. Ex. 7 | 35 | 74 | 10 | — | — | — | 30 | 5 |
| Comp. Ex. 8 | 13 | 90 | 0 | 1114 | 1.29 | 318 | 11 | 2 |
| Comp. Ex. 9 | 7 | 94 | 0 | — | — | — | 6 | 1 |

In comparative examples 8 and 9, condensation occurred.

As can be seen from Table 1, if the relative humidity was higher than 65%, combustion sometimes occurred depending on the environment temperature. And the higher the humidity, the greater the number of times of combustion. As for Comparative Example No. 7 for which the powder had been pressed within an environment with a temperature of 35° C. and a relative humidity of 74%, all of ten samples combusted, so the magnetic properties thereof could not be measured.

The reactivity of the rare earth alloy for use in producing a rare earth permanent magnet steeply rose once the environment temperature exceeded about 30° C. As for Comparative Example 6, the environment temperature was higher than 30° C. and combustion occurred as many as three times, even with the moderate 65% relative humidity.

In Comparative Examples 8 and 9 for which the environment temperature was 13° C. or less and the relative humidity was 90% or more, condensation was caused when the as-pressed compacts were transported to another chamber outside of the pressing chamber. To avoid condensation like this, the environment preferably has a temperature controlled at 15° C. or more and a relative humidity controlled at less than 90%. Also, when the relative humidity of the environment decreases to less than 40%, static electricity is likely accumulated in the compacts and the parts of the pressing machine to create spark discharge and greatly increase the risk of combustion. Accordingly, from safety considerations, the relative humidity of the air environment is preferably controlled at 40% or more.

According to the results of experiments, the air environment most preferably has a temperature controlled to the range from 15° C. through 25° C. and a relative humidity controlled to the range from 40% through 55%.

Table 1 also shows the dew points measured for the environment around the pressing machine. The environment temperature is preferably 30° C. or less and the environment temperature minus the dew point is preferably 6° C. or more. If the environment temperature minus the dew point exceeds 15° C., then the relative humidity is sometimes less than 40%. Accordingly, the environment temperature minus the dew point is preferably 15° C. or less.

According to the present invention, the environment for the pressing/compacting process is the air, not an inert gas. Thus, the temperature and humidity of the environment can be controlled using a normal air conditioner. That is to say, there is no need to design a special air-conditioning system or to change the control system for that purpose. Instead, the temperature and humidity of the environment are controllable just by equipping a chamber where the pressing machine is located with a known air conditioner and by conditioning the air inside the chamber using the conditioner. Not all of the air inside the chamber has to have the controlled temperature and humidity defined by the present invention. Alternatively, the space surrounding the pressing machine may be substantially closed up using partitions, for example, and the environment inside the closed space may have its temperature and humidity controlled using an air conditioner. It should be noted that where multiple pressing machines should be operated at a time in a spacious chamber or factory, the air inside the chamber or factory is preferably controlled using a number of air conditioners.

The temperature and humidity of the air environment may be controlled by any method. Also, there is no problem if some part of a spacious pressing chamber has a temperature higher than 30° C. or a relative humidity exceeding 65%. The point is each part being pressed and every part that might increase the risk of heat generation or combustion of as-pressed compacts should have its temperature and humidity controlled to the predetermined ranges. Accordingly, temperature and/or humidity sensors should preferably be placed near the position where the pressing process is actually performed. This is because so long as the temperature or humidity distribution inside the pressing chamber is known, the sensors may be placed far away from the press spots and yet the press spots and surrounding spots can have their temperatures and humidities controlled based on the outputs of the sensors. For that reason, the present invention is sufficiently implementable even if an air conditioner equipped with the temperature and/or humidity sensor(s) is placed far away from the pressing machine.

Fortunately, the preferable temperature and humidity ranges, optimal for suppressing the heat generation and combustion of the rare earth alloy magnetic powder, overlap with comfortable temperature and humidity ranges in which human beings can work for a long time. Accordingly, there is no need to provide any exclusive space for the pressing machine separately from the normal workers' space and control the temperatures and humidities of these spaces independently.

According to the present invention, a high-performance rare earth permanent magnet, exhibiting excellent magnetic properties, can be produced safely and constantly even from an easily oxidizable rare earth alloy magnetic powder.

In view of the many possible embodiments to which the principles of our invention may be applied, it should be recognized that the detailed embodiments are illustrative only and should not be taken as limiting the scope of our invention. Rather, we claim as our invention all such embodiments as may come within the scope and spirit of the following claims and equivalents thereto.

We claim:

1. A method of forming a green compact of a rare earth alloy magnetic powder comprising the steps of:

providing a rare earth alloy powder, providing a controlled environment having a temperature ranging from 5° C. to 30° C. and a relative humidity ranging from 40% to 65%, and pressing the rare earth alloy powder within the controlled environment.

2. A method of forming a green compact of a rare earth alloy magnetic powder comprising the steps of:

providing a rare earth alloy powder, providing a controlled environment having a temperature ranging from 5° C. to 30° C. and a relative humidity ranging from 40% to 65% and a dew point of at least 6° C. less than the temperature, and pressing the rare earth alloy powder within the controlled environment.

3. The method of claim 1 or 2, further comprising the steps of:

solidifying a molten alloy at a rate from $10^{2}$° C./sec to $10^{4}$° C./sec, and pulverizing the solidified alloy to form the provided rare earth alloy powder.

4. The method of claim 3, wherein the solidified alloy is a rare earth alloy with a thickness between 0.03 mm and 10 mm, and includes $R_2T_{14}B$ crystal grains, where R is a rare earth element, T is either iron or a compound of iron and a transition metal element in which iron is partially replaced with the metal element, and B is boron, and R-rich phases, the sizes of the $R_2T_{14}B$ crystal grains being from 0.1 $\mu$m through 100 $\mu$m in a minor axis direction and from 5 $\mu$m through 500 $\mu$m in a major axis direction, the R-rich phases dispersed around a boundary of the $R_2T_{14}B$ crystal grains.

5. The method of claim 1 or 2, further comprising the step of adding a lubricant to the rare earth alloy powder prior to said pressing step.

6. The method of claim 1 or 2, further comprising the step of providing rare earth alloy powder containing oxygen at 6,000 ppm or less.

7. The method of claim 3, further comprising the step of forming an oxide layer on the surface of particles of the rare earth alloy powder by performing said pulverizing step in a jet mill with a controlled concentration of an oxidizing gas.

8. The method of claim 1 or 2, wherein in said step of providing a controlled environment, the controlled environment has a temperature of 15° C.–25° C. and a relative humidity of 40%–55%.

9. The method of claim 1 or 2, further comprising the steps of:

providing a die pressing machine comprising: a die with a die hole for forming at least a portion of a cavity, and first and second punches for compacting the powder inside the hole;

filling the cavity with the powder with at least an upper end of the second punch inserted into the die hole;

compacting the powder in the die between the first and second punches, thereby forming a green compact of the powder; and ejecting the compact out of the die hole.

10. The method of claim 9, further comprising the step of sintering the compact.

11. The method of claim 10, wherein said pressing step is performed in a first chamber, and said sintering step is performed in a second chamber having a temperature within 5° C. of the first chamber.

12. The method of claim 11, wherein said pressing step is performed in a first chamber large enough for a human being to work therein.

* * * * *